US008584631B2

(12) United States Patent
Fernandez

(10) Patent No.: US 8,584,631 B2
(45) Date of Patent: Nov. 19, 2013

(54) CONTINUOUSLY VARIABLE VALVE LIFT SYSTEM WITH DEFAULT MECHANISM

(75) Inventor: Hermes A. Fernandez, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/461,064

(22) Filed: May 1, 2012

(65) Prior Publication Data

US 2013/0104819 A1 May 2, 2013

Related U.S. Application Data

(60) Provisional application No. 61/554,550, filed on Nov. 2, 2011.

(51) Int. Cl.
*F01L 1/34* (2006.01)

(52) U.S. Cl.
USPC ..... 123/90.16; 123/90.39; 123/90.44; 74/559; 74/569

(58) Field of Classification Search
USPC ..... 123/90.16, 90.39, 90.44; 74/559, 569
See application file for complete search history.

(56) References Cited

U.S. PATENT DOCUMENTS

| | | | | |
|---|---|---|---|---|
| 7,418,933 | B2 | 9/2008 | Mizorogi et al. | |
| 7,610,882 | B2 | 11/2009 | Tsutsumi et al. | |
| 7,886,703 | B2 | 2/2011 | Nakamura | |
| 8,276,556 | B2 * | 10/2012 | Knauf et al. | 123/90.16 |
| 2011/0061618 | A1 | 3/2011 | Rohe et al. | |

* cited by examiner

*Primary Examiner* — Ching Chang
(74) *Attorney, Agent, or Firm* — Thomas N. Twomey

(57) ABSTRACT

A continuously variable valve lift system for actuating a combustion valve of an engine includes a camshaft having a camshaft lobe rotatable about an camshaft axis of rotation. A rocker assembly is pivotable for providing reciprocating motion to the combustion valve. A control shaft is rotatable about a control shaft axis of rotation such that rotation of the control shaft about the control shaft axis of rotation changes the position of the rocker assembly to vary the lift of the combustion valve. An actuator selectively rotates the control shaft between a minimum lift position and a maximum lift position. A bias spring surrounding the control shaft axis of rotation biases the control shaft only from the minimum lift position to a predetermined position which is intermediate the minimum lift position and the maximum lift position upon failure of the actuator.

12 Claims, 5 Drawing Sheets

CONTINUOUSLY VARIABLE VALVE LIFT SYSTEM WITH DEFAULT MECHANISM

CROSS-REFERENCE TO RELATED APPLICATIONS

This patent application claims the benefit of U.S. provisional patent application Ser. No. 61/554,550 filed Nov. 2, 2011, the disclosure of which is hereby incorporated by reference in its entirety.

TECHNICAL FIELD OF INVENTION

The present invention relates to a continuously variable valve lift system for varying the lift of a combustion valve in an internal combustion engine; more particularly to a continuously variable valve lift system with a mechanism for providing a default lift of the combustion valve.

BACKGROUND OF INVENTION

Internal combustion engine manufacturers have been developing continuously variable valve lift (CVVL) systems to actuate combustion valves (intake valves and/or exhaust valves) of an internal combustion engine in an effort to increase fuel economy, decrease emissions, and otherwise improve the performance of the internal combustion engine. These CVVL systems may be applied to only the intake valves, to only the exhaust valves, or to both the intake valves and the exhaust valves depending on the need of the internal combustion engine. CVVL systems are used to vary the magnitude of lift of the combustion valves where valve lift is commonly understood to be the distance the combustion valve is moved from its valve seat. One CVVL system is shown in United States Patent Application Publication No. US 2011/0061618 which is commonly assigned and is incorporated herein by reference in its entirety. In this CVVL system, an engine camshaft with an engine camshaft lobe is rotated about an engine camshaft axis as is customary in the internal combustion engine art. A rocker assembly receives input from the engine camshaft lobe via a roller on the rocker assembly where rotational motion of the engine camshaft lobe causes the rocker assembly to pivot in a reciprocating manner. An output portion of the rocker assembly acts on a roller of a finger follower which pivots on a hydraulic lash adjuster. When the finger follower pivots about the hydraulic lash adjuster, a combustion valve is opened and closed. In order to vary the valve lift of the combustion valve, a control shaft is provided which is rotatable about a control shaft axis by an actuator. Rotation of the control shaft about the control shaft axis changes the position of the rocker assembly which results in a change of valve lift of the combustion valve. In the event of a failure of the actuator, it may be desirable for the CVVL system to default to a predetermined valve lift which allows the internal combustion engine to start and to run satisfactorily until a repair can be made.

U.S. Pat. No. 7,886,703 teaches a CVVL system with a default mechanism for providing a default valve lift in the event of a failure of the actuator which is an electric motor. In this arrangement, rotary motion of the electric motor is converted into linear motion by a ball screw. The linear motion created by the ball screw is converted into rotational motion of the control shaft by linkage attached to the ball screw and the control shaft. The default mechanism includes two compression springs which act in opposing directions to provide a default valve lift. One drawback to this default mechanism arrangement is that the actuator must work against at least one of the compression springs over the full range of motion of the control shaft during operation which increases the capacity requirements of the actuator. Another drawback to this default mechanism is that it must be used in a system where rotational motion of the actuator is converted into linear motion.

U.S. Pat. No. 7,418,933 teaches a CVVL system with a default mechanism for providing a default valve lift in the event of a failure of the actuator which is an electric motor. In this arrangement, the electric motor has an output shaft with a driving gear which meshes with a driven gear. The driven gear is connected to a shaft of a worm gear which meshes with a sector gear of the control shaft of the CVVL system. The default mechanism includes a large diameter gear and a small diameter gear which move with the shaft of the worm gear. A first default spring surrounds the control shaft to bias the control shaft from a maximum lift position to a default position intermediate the maximum lift position and a minimum lift position. A second default spring acts on a gear set, which includes a large diameter gear and a small diameter gear, to bias the control shaft from the minimum lift position the default position. One drawback to this default mechanism arrangement is that the actuator must work against at least one of the default springs over the entire range of motion of the control shaft during operation which increases the capacity requirements of the actuator. Another drawback to this default mechanism is the cost and complexity that are added by the gears that are needed only for the second default spring to bias the control shaft from the minimum lift position to the default position.

What is needed is a CVVL system with a default mechanism which minimizes the size requirements of an actuator of the CVVL system. What is also needed is a CVVL system with a default mechanism that adds minimal components and complexity to the CVVL system.

SUMMARY OF THE INVENTION

Briefly described, a continuously variable valve lift system is provided for actuating a combustion valve of an internal combustion engine. The continuously variable valve lift system includes an engine camshaft having an engine camshaft lobe rotatable about an engine camshaft axis of rotation. The continuously variable valve lift system also includes a rocker assembly that is pivotable for providing reciprocating motion to the combustion valve. The rocker assembly includes a rocker assembly input member for receiving motion from the engine camshaft lobe and a rocker assembly output member for transmitting motion to the combustion valve. The continuously variable valve lift system also includes a control shaft rotatable about a control shaft axis of rotation such that rotation of the control shaft about the control shaft axis of rotation changes the position of the rocker assembly, thereby varying the lift of the combustion valve. The continuously variable valve lift system also includes an actuator for selectively rotating the control shaft between a minimum lift position and a maximum lift position. The continuously variable valve lift system also includes a bias spring surrounding the control shaft axis of rotation for biasing the control shaft only from the minimum lift position to a predetermined position which is intermediate the minimum lift position and the maximum lift position upon failure of the actuator.

BRIEF DESCRIPTION OF DRAWINGS

This invention will be further described with reference to the accompanying drawings in which.

DETAILED DESCRIPTION OF INVENTION

Figure 1B:
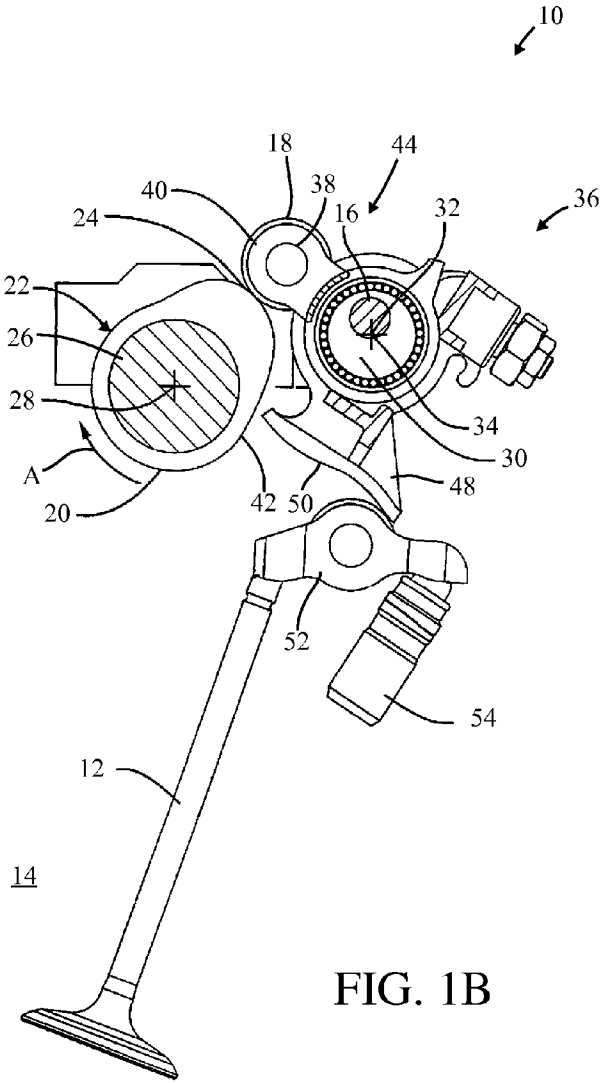
FIG. 1B is the cross-sectional elevation view of FIG. 1A now with the input rocker subassembly on the nose portion of the engine camshaft lobe.
Figure 1A:
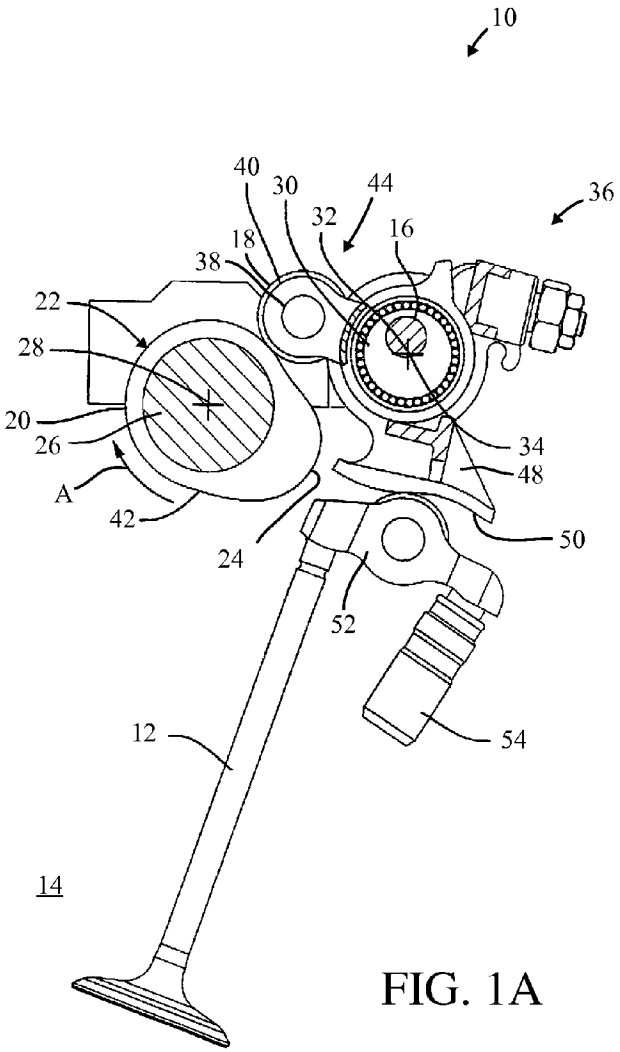
FIG. 1A is a cross-sectional elevation view, from the front of an internal combustion engine, of a CVVL system in accordance with the present invention, with the CVVL system in a high engine load mode and the input rocker subassembly on the base circle of the engine camshaft lobe.
Figure 2B:
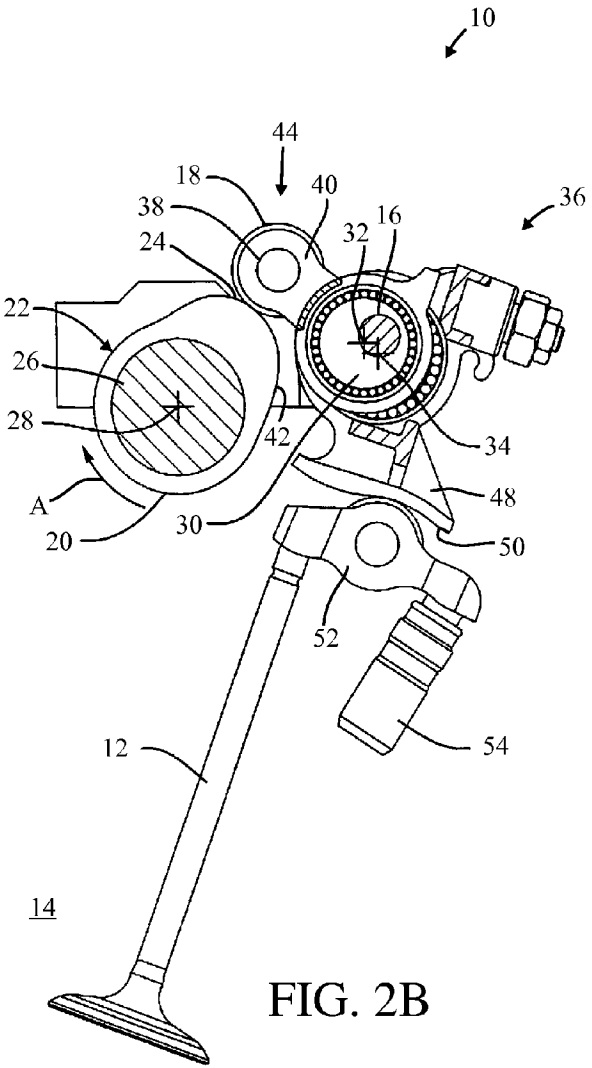
FIG. 2B is the cross-sectional elevation view of FIG. 2A now with the input rocker subassembly on the nose portion of the engine camshaft lobe.

In FIGS. 1A, 1B, 2A, and 2B; CVVL system 10 in accordance with the present invention is shown at one combustion valve 12 of internal combustion engine 14 as viewed from the front of internal combustion engine 14. Combustion valve 12 may either be an intake valve or an exhaust valve. CVVL system 10, when applied to intake valves, manages the internal combustion engine's intake gas exchange process with changes in the angular position of control shaft 16 which is rotatable about control shaft axis of rotation 17 (shown in FIG. 3) which is the geometric center of control shaft 16. Similarly, CVVL system 10, when applied to exhaust valves, manages the internal combustion engine's exhaust exchange process with changes in the angular position of control shaft 16. In FIG. 1A and FIG. 1B, CVVL system 10 is shown in a high engine load mode, and in FIG. 2A and FIG. 2B, CVVL system 10 is shown in a low engine load mode. In each of these pairs of figures, a view of CVVL system 10 with input roller 18 on base circle portion 20 of engine camshaft lobe 22 appears to the left (FIG. 1A and FIG. 2A), and a similar view with input roller 18 on nose portion 24 of engine camshaft lobe 22 (point of maximum lift) appears to the right (FIG. 1B, and FIG. 2B). Engine camshaft lobe 22 is part of engine camshaft 26 which rotates in a conventional manner about engine camshaft axis of rotation 28.

Control shaft 16 is eccentrically fixed to control shaft disc 30 such that control shaft disc 30 rotates eccentrically about control shaft axis of rotation 17 when control shaft 16 is rotated. High engine load events as shown in FIGS. 1A and 1B are produced whenever control shaft 16 is rotationally positioned such that input rocker pivot center 32, which is also the geometric center of control shaft disc 30, and output cam pivot center 34 are coincidental. Input roller 18, which is the input member of rocker assembly 36, is preferably formed of hardened steel and is free to rotate about a steel pin 38 which is staked in place within input rocker clevis 40. As engine camshaft 26 rotates clockwise, as represented by arrow A, opening flank 42 of engine camshaft lobe 22 pushes input roller 18 upward, causing input rocker subassembly 44 of rocker assembly 36 to rotate in a clockwise direction about control shaft disc 30 and about input rocker pivot center 32. As rocker subassembly 36 rotates, it turns about input rocker pivot center 32 of control shaft disc 30. As input rocker subassembly 44 pivots clockwise about input rocker pivot center 32, output rocker subassembly 48 of rocker assembly 36 is caused to rotate clockwise about output rocker pivot center 34 which is fixed in position. Clockwise rotation of output rocker subassembly 48 advances output cam profile 50 of output rocker subassembly 48 which acts on finger follower 52. Output cam profile 50 is the output member of rocker assembly 36. The right end of finger follower 52 pivots about hydraulic valve lash adjuster 54. In this way, output rocker subassembly 48 pushing down on finger follower 52 transmits lift to combustion valve 12. The further that output rocker subassembly 48 is rotated, the greater the lift imparted on combustion valve 12 through finger follower 52.

Figure 3:
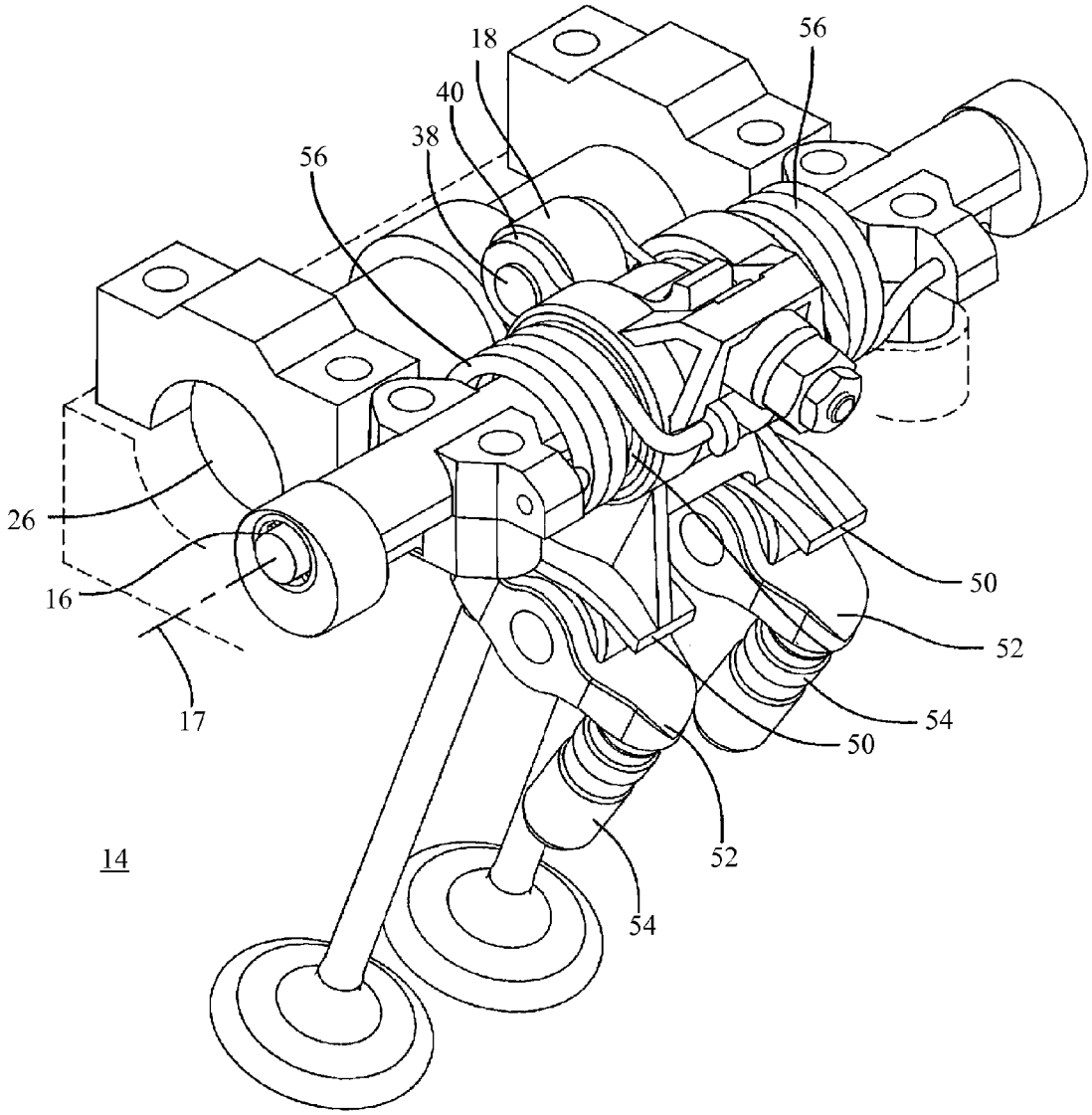
FIG. 3 is an isometric view of the CVVL system at a representative camshaft angle.
Figure 4:
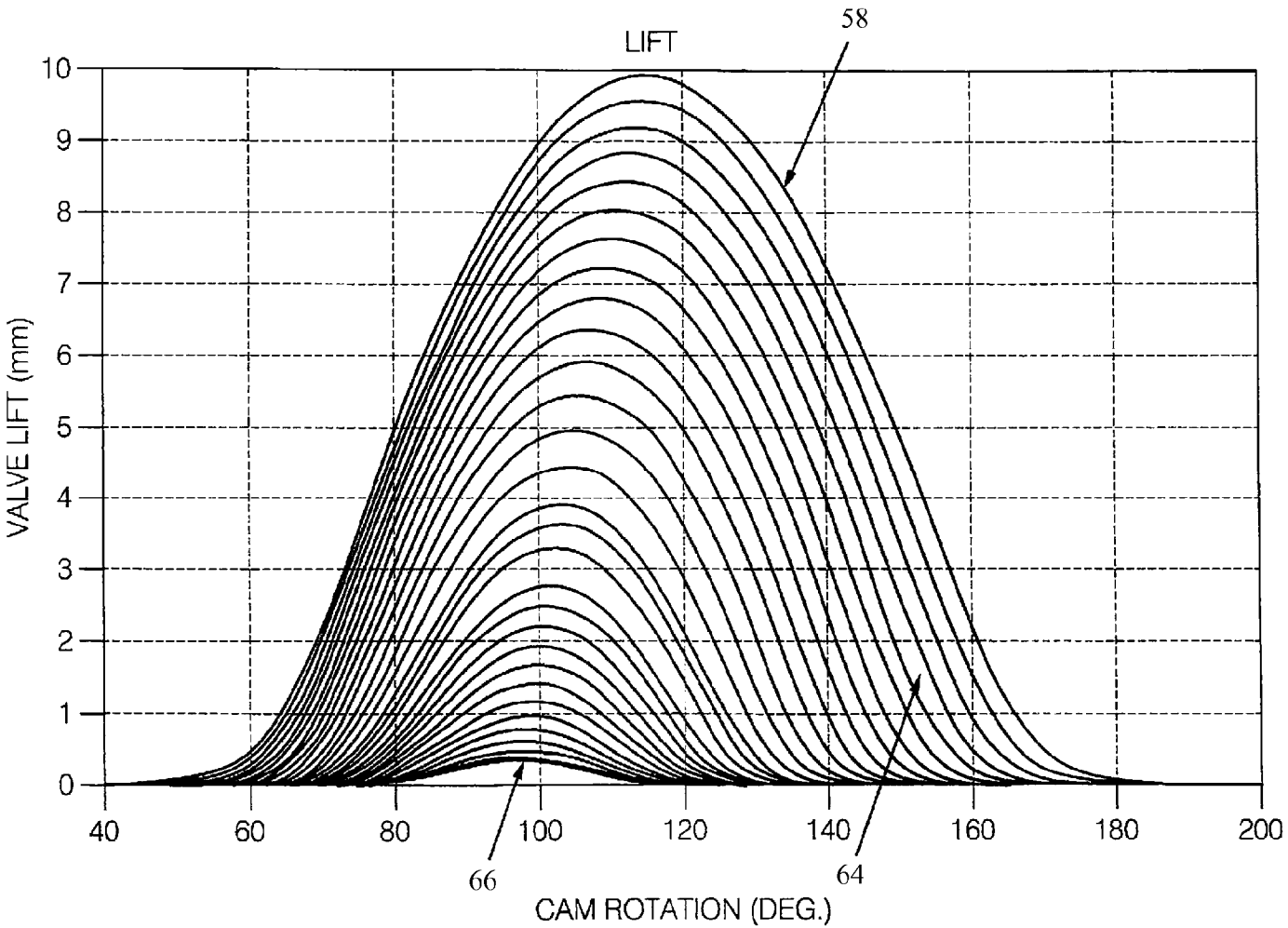
FIG. 4 is a family of representative camshaft timing, lift, and duration curves for a CVVL system in accordance with the present invention.

When control shaft disc 30 is in the high engine load mode, as shown in FIGS. 1A and 1B, maximum lift is imparted to combustion valve 12 whenever input roller 18 reaches nose portion 24 of engine camshaft lobe 22. At this point, input rocker subassembly 44 and output rocker subassembly 48 cease to move in the clockwise direction. As engine camshaft lobe 22 rotates further in the clockwise direction, nose portion 24 of engine camshaft lobe 22 slips past input roller 18, and lash spring 56 (shown in FIG. 3) urges input rocker subassembly 44 and output rocker subassembly 48 to rotate counter-clockwise. This counter-clockwise rotation, in turn, reduces lift produced between output cam profile 50 and finger follower 52. Eventually, as engine camshaft 26 continues to rotate clockwise, input roller 18 reaches base circle portion 20 of engine camshaft lobe 22 where lift remains at zero until the next valve opening event occurs. The motion just described produces a peak lift profile similar to peak lift profile 58 shown in FIG. 4, to maximize gas flow through combustion valve 12.

Figure 2A:
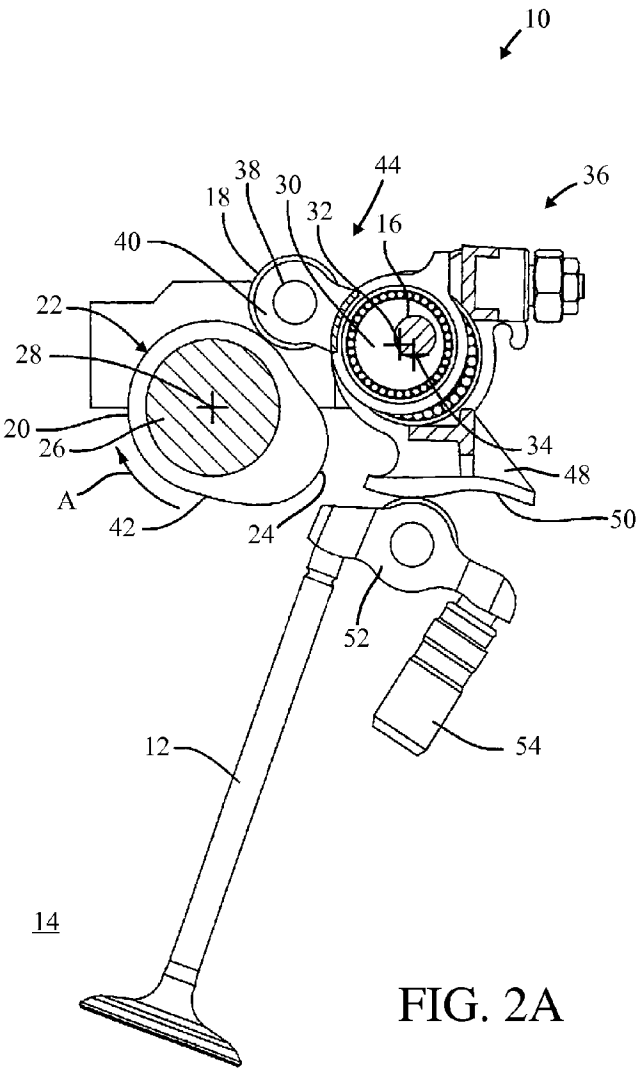
FIG. 2A is the cross-sectional elevation view of FIG. 1A now with the CVVL system in a low engine load mode and the input rocker subassembly on the base circle of the engine camshaft lobe.
Figure 5:
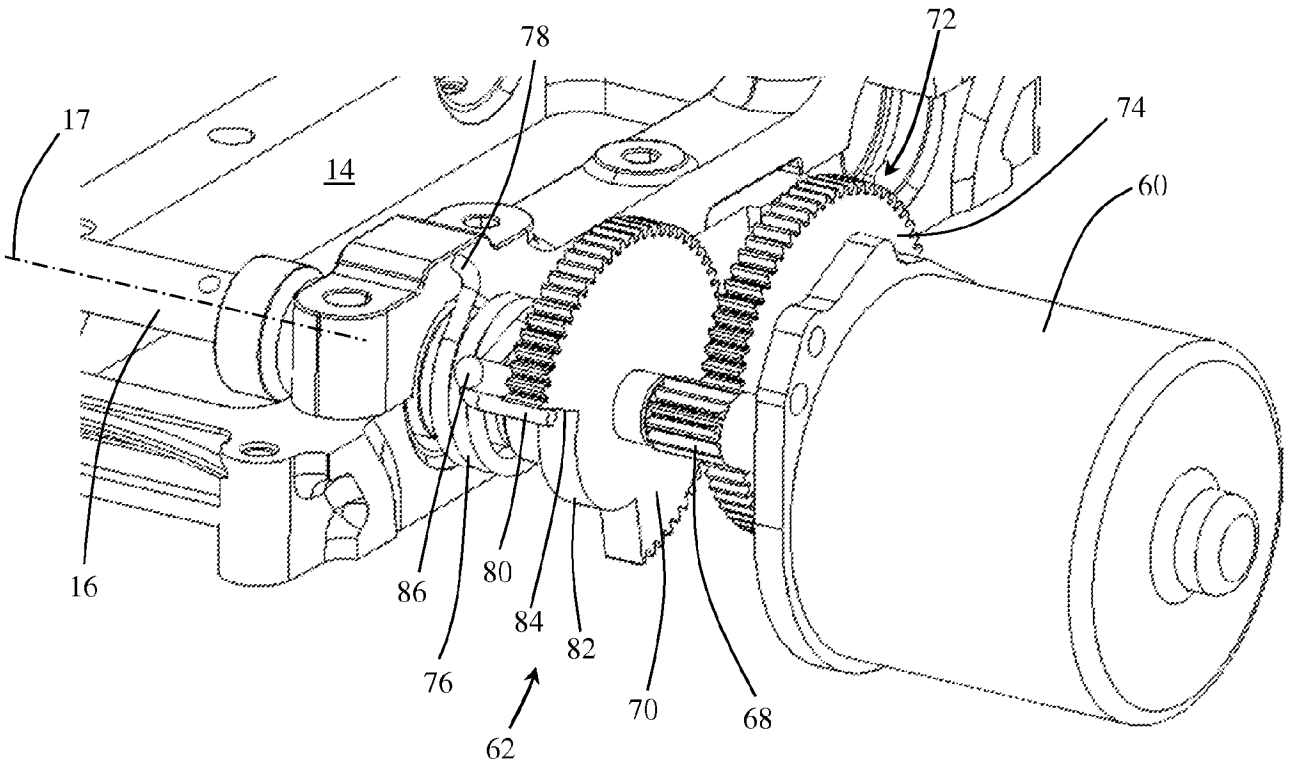
FIG. 5 is an isometric view, from the back of an internal combustion engine, of an actuator and bias spring of the CVVL system in accordance with the present invention.

Referring now to FIGS. 2A, 2B, and 5; an actuator, shown as electric motor 60 (shown only in FIG. 5), is operationally connected to control shaft 16 through gear set 62 in order to change the angular position of control shaft 16. It should be stressed that FIGS. 1A, 1B, 2A, and 2B are viewed from the front of internal combustion engine 14 while FIG. 5 is viewed from back of internal combustion engine 14. As a result, a clockwise rotation of control shaft 16 in FIGS. 1A, 1B, 2A, and 2B corresponds to a counter-clockwise rotation of control shaft 16 in FIG. 5. When control shaft 16 is rotated significantly clockwise, as viewed in FIGS. 2A and 2B or counter-clockwise as viewed in FIG. 5, relative to its high engine load mode position as described previously, CVVL system 10 produces lower lift events (see region 64 of FIG. 4) with reduced duration, corresponding to lower engine loads. When this happens, input rocker pivot center 32 of control shaft disc 30 moves inward toward engine camshaft 26, away from output rocker pivot center 34 of output rocker subassembly 48. Thus, when engine camshaft lobe 22 induces angular motion to input rocker subassembly 44, output rocker subassembly 48 pushes down on finger follower 52 to a lesser magnitude than compared to the high engine load mode of operation, thereby transmitting lesser lift to combustion valve 12. When control shaft 16 is in the lowest engine load mode, CVVL system 10 can generate a short and shallow lift event as represented by curve 66 of FIG. 4 which is suitable for the lightest of all engine loads. While not shown, CVVL system 10 may also prevent combustion valve 12 from opening, which may be required when it is desired to deactivate some cylinders of internal combustion engine 14 as is known to those skilled in the art of cylinder deactivation.

It will be observed that displacement (i.e. rotation) of control shaft 16 from the position shown FIGS. 1A, 1B to that shown in FIGS. 2A, 2B serves to a) change the position of input roller 18 on engine camshaft lobe 22, thereby advancing the start of valve opening and b) to change the contact point of output cam profile 50 with finger follower 52, thereby reducing the potential valve lift. More concisely stated, displacement of control shaft 16 displacement changes the position of rocker assembly 36. Thus, varying the angular position of control shaft 16 between the high engine load position (maximum valve lift position) illustrated in FIGS. 1A, 1B and the low engine load position (minimum valve lift position) illustrated in FIGS. 2A, 2B produces the entire lift curve family depicted in FIG. 4.

Reference will now be made to FIG. 5 which, for clarity, has had all elements of CVVL system 10 removed except for control shaft 16, electric motor 60, gear set 62, and other elements that will be described herein. Gear set 62 includes drive gear 68 which is fixed to the output shaft of electric motor 60 to rotate with the output shaft in a one-to-one relationship when an electric current is applied to electric motor 60. Gear set 62 also includes driven gear 70 which is fixed to control shaft 16 to rotate with control shaft 16 in a one-to-one relationship. Gear set 62 also includes intermediate gear 72 which is operationally disposed between drive gear 68 and driven gear 70. Intermediate gear 72 includes intermediate large diameter gear 74 which meshes with drive gear 68. Intermediate gear 72 also includes an intermediate small diameter gear (which is not shown because it is hidden behind intermediate large diameter gear 74) which is fixed to intermediate large diameter gear 74 in order to rotate with intermediate large diameter gear 74 in a one-to-one relationship. The intermediate small diameter gear meshes with driven gear 70. In this way, rotation of drive gear 68 by electric motor 60 causes rotation of control shaft 16.

A default mechanism, shown in part as bias spring 76, is provided in order to move control shaft 16 to a predetermined position intermediate of the minimum lift position and the maximum lift position in the event of a failure of electric motor 60. Bias spring 76 is a torsional spring which surrounds control shaft axis of rotation 17. Bias spring stationary end 78 of bias spring 76 is grounded to internal combustion engine 14 while bias spring moveable end 80 of bias spring 76 applies a biasing force to driven gear 70 only from the minimum lift position to the predetermined position. Driven gear 70 includes cutaway sector 82 which provides reaction surface 84 for bias spring moveable end 80 to act upon from the minimum lift position to the predetermined position. In an alternative not shown, an arcuate slot may be substituted for cutaway sector 82. When control shaft 16 reaches the predetermined position, bias spring moveable end 80 is prevented from moving further by spring stop 86 which is fixed to internal combustion engine 14. FIG. 5 shows control shaft 16 in the predetermined position, and as can be seen, bias spring moveable end 80 is in contact with spring stop 86 and reaction surface 84. If electric motor 60 were to be actuated to rotate driven gear 70 in a clockwise direction as viewed in FIG. 5, spring stop 86 would prevent bias spring moveable end 80 from moving and reaction surface 84 would no longer be in contact with bias spring moveable end 80. As a result, bias spring 76 would no longer have an effect on electric motor 60 and control shaft 16. Conversely, if electric motor 60 were to be actuated to rotate driven gear 70 in a counter-clockwise direction as viewed in FIG. 5, reaction surface 84 would cause bias spring 76 to wind up and bias spring moveable end 80 would no longer be in contact with spring stop 86. As a result, bias spring 76 would provide a biasing force on control shaft 16 via driven gear 70 that would urge control shaft 16 to the intermediate position if a failure of electric motor 60 were to occur.

While bias spring 76 will urge control shaft 16 to the predetermined position if electric motor 60 fails when control shaft 16 is positioned between the minimum lift position and the predetermined position, bias spring 76 does not urge control shaft 16 to the predetermined position if electric motor 60 fails when control shaft 16 is positioned between the maximum lift position and the predetermined position. Instead only the forces generated by engine camshaft lobe 22 and combustion valve 12 acting on rocker assembly 36 will urge control shaft 16 to the predetermined position. When control shaft 16 reaches the predetermined position, reaction surface 84 will come into contact with bias spring moveable end 80. Bias spring 76 is selected to provide a spring force that will resist the forces generated by engine camshaft lobe 22 and combustion valve 12 acting on rocker assembly 36. As a result, the forces generated by engine camshaft lobe 22 acting on rocker assembly 36 are unable to wind up bias spring 76 and control shaft 16 is maintained at the predetermined position.

Since electric motor 60 only needs to work against one bias spring for only a portion of the total range of motion of control shaft 16, electric motor 60 does not need to be increased in load capacity to overcome the forces of two springs which would be needed if a bias spring were provided to bias control shaft 16 toward the predetermined position from both the minimum lift position and the maximum lift position. Furthermore, since there is only one bias spring, there are fewer CVVL system components and the design of the CVVL system is simplified and more compact.

While this invention has been described in terms of preferred embodiments thereof, it is not intended to be so limited.

I claim:

1. A continuously variable valve lift system for actuating a combustion valve of an internal combustion engine, said continuously variable valve lift system comprising:

an engine camshaft having an engine camshaft lobe, said engine camshaft lobe being rotatable about an engine camshaft axis of rotation;

a rocker assembly that is pivotable for providing reciprocating motion to said combustion valve, said rocker assembly having a rocker assembly input member for receiving motion from said engine camshaft lobe and a rocker assembly output member for transmitting motion to said combustion valve;

a control shaft rotatable about a control shaft axis of rotation, wherein rotation of said control shaft about said control shaft axis of rotation changes the position of said rocker assembly, thereby varying the lift of said combustion valve;

an actuator for selectively rotating said control shaft between a minimum lift position and a maximum lift position;

and a bias spring surrounding said control shaft axis of rotation for biasing said control shaft only from said minimum lift position to a predetermined position which is intermediate said minimum lift position and said maximum lift position upon failure of said actuator.

2. A continuously variable valve lift system as in claim 1 wherein only forces generated by one of said engine camshaft and said combustion valve bias said control shaft from said maximum lift position to said predetermined position upon failure of said actuator.

3. A continuously variable valve lift system as in claim 1 wherein said actuator is connected to said control shaft through a gear set.

4. A continuously variable valve lift system as in claim 3 wherein said gear set includes a drive gear connected to said actuator and a driven gear connected to said control shaft such that said driven gear rotates with said control shaft in a one-to-one relationship and such that rotation of said drive gear causes said driven gear to rotate.

5. A continuously variable valve lift system as in claim 4 wherein said bias spring includes a stationary end grounded to said internal combustion engine and a moveable end for applying a biasing force to a reaction surface of said driven gear only when said control shaft is positioned from said minimum lift position to said predetermined position.

6. A continuously variable valve lift system as in claim 5 wherein said reaction surface is defined by a cutaway sector of said driven gear.

7. A continuously variable valve lift system as in claim 5 wherein said moveable end rotates with said driven gear when said control shaft is rotated from said minimum lift position to said predetermined position or from said predetermined position to said minimum lift position.

8. A continuously variable valve lift system as in claim 5 wherein said moveable end does not contact said driven gear when said control shaft is between said predetermined position and said maximum lift position.

9. A continuously variable valve lift system as in claim 5 wherein said moveable end is stationary when said control shaft is rotated between said predetermined position and said maximum lift position.

10. A continuously variable valve lift system as in claim 5 further comprising a spring stop fixed to said internal combustion engine to prevent said moveable end of said bias spring from applying said biasing force on said driven gear when said control shaft is between said predetermined position and said maximum lift position.

11. A continuously variable valve lift system as in claim 10 wherein said moveable end of said bias spring contacts said spring stop when said control shaft is positioned from said predetermined position to said maximum lift position.

12. A continuously variable valve lift system as in claim 11 wherein said moveable end of said bias spring is not in contact with said spring stop when said control shaft is positioned between said predetermined position and said minimum lift position.

* * * * *